US005911900A

United States Patent [19]

Muroi et al.

[11] Patent Number: 5,911,900

[45] Date of Patent: Jun. 15, 1999

[54] CONTINUOUS CASTING NOZZLE FOR CASTING MOLTEN STEEL

[75] Inventors: Toshiyuki Muroi; Shojiro Naito, both of Gifu-ken, Japan

[73] Assignee: Akechi Ceramics, Gitu-Ken, Japan

[21] Appl. No.: 08/975,676

[22] Filed: Nov. 28, 1997

Related U.S. Application Data

[63] Continuation-in-part of application No. 08/911,535, Oct. 16, 1997, Pat. No. 5,858,261.

[30] Foreign Application Priority Data

Dec. 5, 1996 [JP] Japan ..... 8-342597

[51] Int. Cl.[6] ..... B22D 35/00

[52] U.S. Cl. ..... 222/606; 501/101

[58] Field of Search ..... 266/280, 286; 222/606, 607; 501/84, 101, 99

[56] References Cited

U.S. PATENT DOCUMENTS 4,208,214 6/1980 Stein et al. ..... 501/101

5,482,904 1/1996 Kawabe et al. ..... 501/84

*Primary Examiner*—Scott Kastler

*Attorney, Agent, or Firm*—Thorp Reed & Armstrong LLP

[57] ABSTRACT

The invention is related to a continuous casting nozzle for casting of aluminum killed steel without clogging of the bore of the nozzle. The surface layer of the bore of the continuous casting nozzle contacting with the molten steel is formed of a refractory comprising graphite from 10 to 35 wt %, an aggregate of 10 to 60 wt % selected from alumina matter, zirconia matter, zircon matter, or alumina-silica matter and roseki containing the pyrophyllite ($Al_2O_3 \cdot 4SiO_2 \cdot H_2O$) as the main component as the remaining part of the above mentioned materials.

7 Claims, 1 Drawing Sheet

CONTINUOUS CASTING NOZZLE FOR CASTING MOLTEN STEEL

This is a continuation-in-part application of U.S. Pat. application Ser. No. 8/911,535 filed on Oct. 16, 1997, now U.S. Pat. No. 5,858,261 the contents of which is incorporated herein by reference.

BACKGROUND OF THE INVENTION

1. Field of the Invention

The present invention relates to a continuous casting nozzle for permitting effective prevention of narrowing of, clogging of or metal sticking to the nozzle bore through which molten steel passes when performing continuous casting of molten steel containing aluminum such as aluminum-killed steel.

2. Description of the Related Art

A continuous casting nozzle for casting molten steel is used for the following purposes. As for continuous casting molten steel, a continuous casting nozzle is used for the purpose of preventing the molten steel from being oxidized by contacting the open air, from splashing when the molten steel is poured from a tundish to a mold, and rectifying the flow of the molten steel poured for preventing non-metallic inclusion and slag present near or on the mold surface from being entrapped in the cast steel strand.

Material of a conventional continuous casting nozzle of molten steel comprises such material as graphite, alumina, silica, silicon carbide and recently zirconia. However, there are the following problems in the case of casting aluminum-killed steel and the like.

As for the aluminum-killed steel and the like, aluminum, which is added as a deoxidizer, it reacts with oxygen existing in the molten steel to produce non-metallic inclusion such as alumina. Therefore, in casting the aluminum-killed steel and the like, the non-metallic inclusion such as the alumina adheres and accumulates onto the surface of the bore of the continuous casting nozzle, so that the bore is narrowed or clogged up in the worst case, which makes stable casting difficult. Furthermore, the non-metallic inclusion such as the alumina adhered or accumulated onto the surface of the bore peels off or falls down, and is entrapped in the cast steel strand, thus degrading the quality of the cast steel strand.

For the purpose of preventing the above-mentioned reduction or clogging of the bore caused by the non-metallic inclusion such as alumina, there is a commonly used method for preventing the non-metallic inclusion such as alumina existing in the molten steel from adhering or accumulating onto the surface of the bore of the nozzle by ejecting inert gas from the inner surface of the nozzle bore toward the molten steel flowing through the bore. One example of this method is described in Japanese Patent Publication No. Hei 6-59533/1994.

However, the method wherein the inert gas is ejected from the inner surface of the nozzle forming the bore has the following problem. A large amount of the ejected inert gas causes entrapment of bubbles produced by the inert gas into the cast steel strand, resulting in defects based on needle-like gas bubbles or pinholes. On the other hand, a small amount of the ejected inert gas causes adhesion and accumulation of the non-metallic inclusion such as the alumina onto the surface of the bore of the nozzle, thus, in the worst case, causing narrowing or clogging of the bore.

Additionally, it is constructionally difficult to uniformly eject the inert gas from the inner surface of the nozzle bore toward the molten steel flowing through the bore. In the instance where the casting is performed for a long period of time, a stable control of the amount of ejected inert gas becomes gradually more difficult, as the structure and the structure of the material consisting of the continuous casting nozzle degrades. And moreover, it becomes difficult to eject inert gas uniformly from the inner surface to the nozzle bore. As a result, the non-metallic inclusion such as the alumina adheres and accumulates onto the surface of the bore of the nozzle so that the bore is narrowed or clogged at the end.

It is thought that the clogging of the nozzle by the non-metallic inclusion, especially by the alumina inclusion, is caused as described below.

(1) Alumina inclusion is produced from aluminum existing in the steel by secondary oxidation, such as oxidation by entrapped air passing through a refractory junction and refractory structure or oxidation by supplying oxygen obtained from reduction of silica in a graphite or carbon-containing refractory.

(2) Alumina inclusion is produced by diffusion and cohesion of the alumina produced in the above process.

(3) Graphite on the surface of the nozzle bore vanishes and the surface of the bore becomes rough and the alumina inclusion is apt to accumulate on the rough surface of the bore.

On the other hand, as an alternative in view of the nozzle material, a nozzle having a non-oxide raw material (SiC, $Si_3N_4$, BN, $ZrB_2$, SIALON, etc.) with low reactivity with aluminum oxide is added to alumina-graphite or a nozzle consisting of the non-oxide material itself is proposed. An example of this alternative is described in Japanese Patent Publication No. Sho 61-38158/1986.

However, this alternative is not practical in the case of the alumina-graphite nozzle, because the adhesion preventing effect is not recognized and further corrosion resistance is decreased unless a large amount of the non-oxide material is added.

Also, a nozzle only consisting of the non-oxide material is not suitable for practical use in view of material cost and manufacturing cost, although a substantial effect is expected.

A nozzle consisting of graphite-oxide raw material containing CaO is proposed for producing low-melting-point material by a reaction of CaO in an oxide raw material containing CaO ($CaO{\cdot}ZrO_2$, $CaO{\cdot}SiO_2$, $2CaO{\cdot}SiO_2$, etc.) with $Al_2O_3$ and forming the low-melting-point material in the steel. An example of this type of nozzle is described in Japanese Patent Laid-Open Publication No. Sho 62-56101.

However, reactivity of CaO with $Al_2O_3$ is apt to be influenced by the temperature of the molten steel when casting, and in one instance, the amount of CaO is not sufficiently secured for satisfying spalling resistance and corrosion resistance when a sufficient amount of $Al_2O_3$ inclusion is contained in the steel.

SUMMARY OF THE INVENTION

The object of the present invention is to provide a continuous casting nozzle having features of forming a glass layer at the surface of the bore of the nozzle when the nozzle is used, thereby preventing air from being entrapped through refractory structure, smoothing the bore surface of the nozzle and preventing the accumulation of alumina. Also, the object of the present invention is to provide a continuous casting nozzle which prevents erosion by products having a low-melting point on account of a reaction between an aggregate in a refractory and alumina in the steel, and to provide the nozzle which is not influenced by the temperature of the molten steel in casting, and which is able to prevent the bore from narrowing or clogging economically, comparatively easily and stably.

In the present invention, the surface layer of the bore of a continuous casting nozzle contacting with molten steel is formed of a refractory comprising graphite from 10 to 35 wt %, an aggregate of 10 to 60 wt % selected from alumina matter, zirconia matter, zircon matter, or alumina-silica matter and roseki containing the pyrophyllite ($Al_2O_3 \cdot 4SiO_2 \cdot H_2O$) as the main component as the remaining part of the above mentioned materials.

In another embodiment of the present invention, the surface layer of the bore of a continuous casting nozzle contacting with molten steel is formed of a refractory comprising graphite from 10 to 35 wt %, an aggregate of 10 to 60 wt % selected from alumina matter, zirconia matter, zircon matter, or alumina-silica matter and roseki containing the pyrophyllite ($Al_2O_3 \cdot 4SiO_2 \cdot H_2O$) as the main component as the remaining part of the above mentioned materials. The refractory being added binder, kneaded, formed, and sintered in the anti-oxidizing atmosphere.

It is preferable that the roseki containing the pyrophyllite as the main component is calcinated at a temperature equal to or greater than 800° C. so as to vanish crystal water and contain alkaline component from 1 to 5 wt %. As for the roseki having the above mentioned component, it is preferable that a mixing weight ratio of roseki with an average grain diameter equal to or less than 250 $\mu$m is equal to or less than 60% relative to the whole of the roseki content.

Furthermore, the mixing weight ratio of roseki whose average grain diameter equal to or less than 250 $\mu$m, is equal to or less than 60% relative to the whole of the roseki content.

And as for the binder a thermosetting resin, for example, phenol resin is preferable selected. With respect to the forming process, cold isostatic process (CIP) should be preferably selected.

DETAILED DESCRIPTION OF THE EMBODIMENTS OF THE INVENTION

Figure 1:
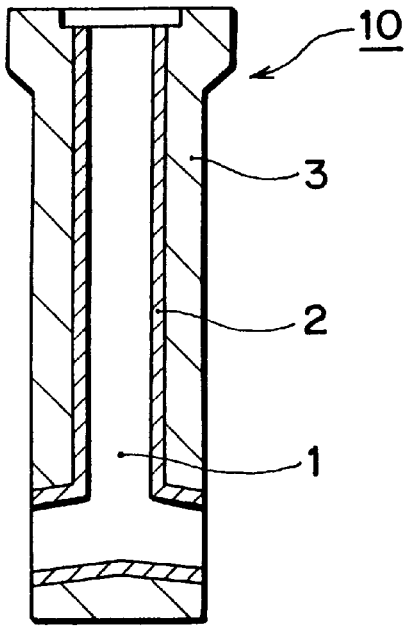
FIG. 1 shows a longitudinal cross section of a nozzle according to the present invention comprising an invented refractory at the surface layer of the bore of the nozzle.

A major characteristic of a continuous casting nozzle of the present invention is that the main component of a refractory of the surface layer of the bore of the nozzle is roseki. During usage, when silica in the above mentioned refractory coexists with graphite or carbon, the following reactions are usually caused.

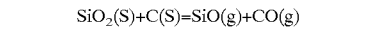

$$SiO_2(S)+C(S)=SiO(g)+CO(g)$$

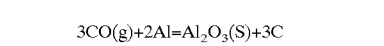

$$3SiO(g)+2Al=Al_2O_3(S)+3Si$$

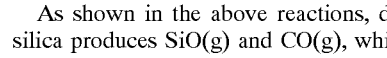

$$3CO(g)+2Al=Al_2O_3(S)+3C$$

As shown in the above reactions, decomposition of the silica produces SiO(g) and CO(g), which react with aluminum in the steel to form $Al_2O_3$ and it becomes the source of oxygen to the steel.

However, as for the roseki, the roseki particles do not decompose even if it coexists with graphite or carbon, namely $SiO_2$ in pyrophyllite ($Al_2O_3 \cdot 4SiO_2 \cdot H_2O$), the main mineral of the roseki is stable. This fact is based on the fact that the particles do not decay and bubbles are not produced, which is confirmed by means of a microscope observation after forming a briquette consisting of the roseki, resin powders and carbon powders and performing heat-treatment at a temperature of 1500° C. for 24 hours with burying it in a coke breeze.

The half-melting temperature of the roseki is about 1500° C., so that it melts at the bore surface contacting the molten steel to form a glass coat for smoothing the structure of the surface of the bore and for preventing air from being entrapped through a refractory structure.

This is found from the fact that the permeability is decreased such that the permeability after performing heat-treatment at a temperature of 1500° C. for 1 hours is as small as about $9.5\times10^{-5}$ darcy, in contrast, the permeability after performing heat-treatment at a temperature of 1000° C. for 1 hours is about $9.5\times10^{-4}$ darcy.

Although the mixing amount of the roseki is the remaining part of the mixing amount of other components, a mixing weight ratio of the roseki is preferably equal to or more than 30 wt % in order to actively form the glass coat on the surface of the bore in use as continuous casting nozzle. Also, it is preferable that the mixing weight ratio of the roseki is equal to or less than 80 wt % because the degree of softening deformation is large with a range of over 80 wt %. The most preferable mixing weight ratio of the roseki is from 30 wt % to 60 wt %. In this case the aggregate of roseki particles does not decompose even when coexisting with graphite.

The present invention provides for the use of three kinds of roseki, that is pyrophyllite matter roseki, kaolin matter roseki, and sericite matter roseki. The pyrophyllite matter roseki with refractoriness from SK29 to SK32 is suitable considering formation of a glass layer and erosion resistance against the molten steel as the surface of the bore contacting with the molten steel is half-molten in use, wherein SK is a Japanese Standard for refractoriness. Both of the kaolin matter roseki and the sericite matter roseki is less preferred, because the kaolin matter roseki has a greater refractoriness from SK33 to SK36, and the sericite matter roseki has a smaller refractoriness from SK26 to SK29.

As for the binder for forming the nozzle body, a thermosetting resin, for example phenol resin, is preferably used and the mixing ratio is preferably 5 to 15 wt %. The most preferable process for the mixed material is CIP(cold isostatic pressing) to produce the nozzle having a high heat resistance.

Sintering of the formed body is preferably performed in the nonoxidizing atmosphere to minimize the burning loss of the graphite mixed in the material, which is mixed to enhance the erosion resistance and oxidation resistance and the sintering temperature is preferably between 1000 to 1200° C. to obtain a sufficient strength of the nozzle.

The reason for using the roseki calcinated at a temperature equal to or greater than 800° C. to vanish crystal water is that the crystal water is released from the roseki at a temperature in a range of from 500 to 800° C. in sintering and the refractory cracks by virtue of an unusually large coefficient of thermal expansion in this range. The alkaline component of the roseki from 1 to 5 wt % is preferable to adequately control the melting point of roseki.

It is preferable that a mixing weight ratio of roseki with an average grain diameter of equal to or less than 250 $\mu$m is equal to or less than 60% relative to the whole of the roseki content because, in the range of over 60%, structural defects such as lamination are apt to be produced in molding and softening deformation of roseki particles is apt to happen when used in a continuous casting nozzle.

The half-melting temperature of the roseki is about 1500° C., and it melts at the bore surface contacting with the molten steel to form a glass coat for smoothing the structure of the surface of the bore and for preventing air from being entrapped through a refractory structure, so that it has the effect to depress the adherence of $Al_2O_3$ and metal.

To prevent the softening deformation and to maintain heat-impact resistance of the roseki, a mixing weight ratio of the graphite is preferably equal to or more than 10 wt %. Also, it is preferred that the mixing weight ratio of the graphite is equal to or less than 35 wt % from the view point of manufacturing of the nozzle because the volume ratio of the graphite relative to the roseki is too large so that structural defects such as lamination are apt to be produced when in the range of over 35 wt %. Considering thermal conductivity and oxidation resistance, natural graphite is suitable as the graphite to be mixed.

As for the aggregate to be mixed, an aggregate of 10 to 60 wt % selected from alumina matter, zirconia matter, zircon matter, or alumina-silica matter should be selected to obtain a sufficient erosion resistance of the nozzle against molten steel.

The continuous casting nozzle for steel according to the present invention will be described in detail with reference to the accompanying drawings of nozzle for continuous casting.

EXAMPLES

The present invention is explained by the examples described below. Samples Nos. 1 to 5 (hereinafter referred to as the "sample of the present invention") having the chemical compositions within the scope of the present invention, and Samples Nos. 6 to 8 (hereinafter referred to as "sample for comparison") having chemical compositions out of the scope of the present invention were prepared as shown in Table 1, and phenolic resin in the state of powder and liquid was added in an amount of from 5 to 10 wt % to each of the mixed materials. From the mixed materials above, the following formed bodies were prepared.

A first formed body (hereinafter referred to as the "formed body 1") was formed with dimensions of 30 mm by 30 mm by 230 mm for examining an amount of adhesion of non-metallic inclusion such as alumina and corrosion resistance against the molten steel. A second formed body (hereinafter referred to as the "formed body 2") with dimensions of 50 mm by 20 mm for examining permeability, and a third formed body (hereinafter referred to as the "formed body 3") was formed with dimensions of 100 mm outer diameter, 60 mm inner diameter and 250 mm length for examining spalling resistance. Then the bodies were sintered in reduced atmosphere at a temperature in a range from 1000 to 1200° C. and Samples Nos. 1 to 8 were prepared.

The physical properties of porosity and bulk density for each of the abovementioned samples of the present invention Nos. 1 to 5 and the samples for comparison Nos. 6 to 8 are shown in Table 1.

TABLE 1

| | | Sample No. of the Present Invention | | | | | Sample No. for Comparison | | |
|---|---|---|---|---|---|---|---|---|---|
| | | 1 | 2 | 3 | 4 | 5 | 6 | 7 | 8 |
| Mixing Composition (wt %) | Graphite | 10 | 10 | 10 | 20 | 35 | 5 | 25 | 25 |
| | Roseki (0.5–1 mm) | 35 | 25 | 20 | 15 | 15 | 35 | — | — |
| | Roseki (−0.25 mm) | 45 | 35 | 20 | 15 | 15 | 50 | — | — |
| | $Al_2O_3$ | 10 | 30 | 50 | 50 | 35 | 10 | 50 | 70 |
| | $SiO_2$ | | | | | | | 25 | |
| Physical Properties | Porosity (%) | 13.7 | 13.8 | 13.6 | 13.5 | 16.2 | 13.5 | 12.8 | 16.4 |
| | Bulk density | 2.19 | 2.21 | 2.30 | 2.31 | 2.05 | 2.22 | 2.30 | 2.56 |
| | Modulus of Rupture (MPa) | 8.8 | 9.2 | 9.5 | 9.5 | 7.0 | 8.5 | 12.1 | 8.0 |
| | Erosion to Molten Steel (%) | 10 | 7 | 3 | 3 | 5 | 20 | 3 | 1 |
| | Permeability ($\times 10^{-5}$ darcy) after Heat-treatment 1500° C.-1 hr | 4.0 | 7.5 | 10.0 | 13.0 | 12.0 | 3.0 | 65 | 95 |
| | Spalling Resistance | No crack | No crack | No crack | No crack | No crack | Crack occurrence | No crack | Crack occurrence |
| | Amount of Adhesion of Alumina | 0 | 0 | 0.5 | 1.0 | 0.5 | 5 | 15 | 10 |

As shown in FIG. 1, a surface layer 2 of the bore 1 of the immersion nozzle 10, through which the molten steel flows, consists of a refractory having the chemical composition as described above. The remaining part of the nozzle 3 is composed of regular refractory, for example, of alumina-graphite which is already known. The dimensions of the nozzle are about 1,000 mm total length, about 60 mm bore diameter, 160 mm outer diameter, and about 50 mm thickness.

Figure 2:
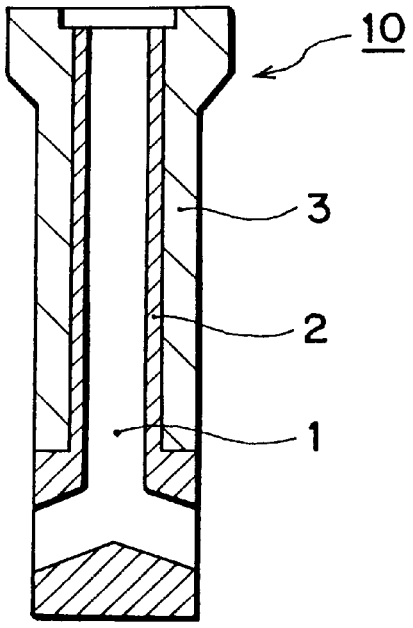
FIG. 2 shows a longitudinal cross section of a nozzle according to the present invention comprising an invented refractory at the surface layer of the bore of the nozzle wherein the lower part of the nozzle is immersed in the molten steel.

FIG. 2 shows another embodiment of the invention, a nozzle comprising a refractory according to the present invention at the surface layer of the bore of the nozzle and the lower part of the nozzle being immersed in the molten steel. In the bore 1 of the nozzle for continuous casting, the adherence and accumulation of non-metallic inclusion such as the alumina are decreased.

The spalling resistance of each of the sintered formed bodies 3 of the samples of the present invention Nos. 1 to 5 and the samples for comparison Nos. 6 to 8 were examined after being heated at a temperature of 1500° C. for 80 minutes in an electric furnace and then rapidly cooling by water. The results are shown in Table 1.

An erosion ratio (%) and an amount of adhesion of non-metallic inclusion such as alumina of each of the sintered formed bodies 1 of the samples of the present invention Nos. 1 to 5 and the samples for comparison Nos. 6 to 8 were examined after being immersed in molten steel, which contained aluminum in a range from 0.02 to 0.05 wt %, at a temperature of 1550° C. for 180 minutes. The results are shown in Table 1.

The permeability for each of the sintered formed bodies 2 of the samples of the present invention Nos. 1 to 5 and the samples for comparison Nos. 6 to 8 were examined after being heated at a temperature of 1500° C. for 60 minutes in an electric furnace and then cooled. The results are shown in Table 1.

It is easily understood from Table 1 that the samples of the present invention are superior in the spalling resistance so the nozzle is not destroyed at the beginning of casting. Also, the non-metallic inclusion such as alumina does not adhere in spite of the low erosion ration, thereby effectively preventing narrowing or clogging of the continuous casting nozzle of the molten steel.

It is also possible for the samples of the present invention to prevent air from being entrapped through the refractory in practical use because of small permeability.

On the other hand, it is obvious that the sample for comparison No. 6 is remarkably inferior in spalling resistance and corrosion resistance against the molten steel, although a small amount of alumina adheres due to much roseki content.

As for the sample for comparison No. 7, the amount of adhesion of alumina is remarkably large, because it contains $Al_2O_3$ and $SiO_2$, which decomposes to supply oxygen to the steel, instead of the roseki.

As for the sample for comparison No. 8, it does not contain $SiO_2$ instead of roseki and contains only $Al_2O_3$ and it has high permeability and the amount of adhesion of alumina is remarkably large, although it contains no mineral source of oxygen to the steel.

Therefore, with the use of the continuous casting nozzle for casting steel according to the present invention, it is possible to perform stable casting while preventing narrowing or clogging of the bore caused by the non-metallic inclusion such as alumina without deterioration of the refractory structure.

According to the present invention, approximately 300 ton of a low carbon aluminum killed steel of 5 to 7 charges is continuously cast with one nozzle without clogging by two (2) strand slab caster in real operation, though with conventional nozzle, clogging up in the nozzle occurred within 2 to 4 charges under the same conditions.

We claim:

1. A continuous casting nozzle for casting molten steel, wherein the surface layer of the bore of said continuous casting nozzle contacting with the molten steel is formed of a refractory comprising:

(a) graphite from 10 to 35 wt %;

(b) an aggregate of 10 to 60 wt % selected from alumina, zirconia, zircon, or alumina-silica; and (c) roseki containing the pyrophyllite ($Al_2O_3 \cdot 4SiO_2 \cdot H_2O$) as the main component as the remaining part of the above mentioned materials.

2. A continuous casting nozzle for casting molten steel, wherein the surface layer of the bore of said continuous casting nozzle contacting with the molten steel is formed of a refractory comprising:

(a) graphite from 10 to 35 wt %;

(b) an aggregate of 10 to 60 wt % selected from alumina, zirconia, zircon, or alumina-silica;

(c) roseki containing the pyrophyllite ($Al_2O_3 \cdot 4SiO_2 \cdot H_2O$) as the main component as the remaining part of the above mentioned materials; and a binder being added to said refractory, said refractory with said binder added being kneaded, formed and sintered in an anti-oxidizing atmosphere.

3. A continuous casting nozzle according to claim 1, wherein said roseki containing the pyrophyllite as the main component, is calcinated at a temperature equal to or greater than 800° C. so as to remove any residual moisture while containing an alkaline component from 1 to 5 wt %.

4. A continuous casting nozzle according to claim 2, wherein a mixing weight ratio of said roseki, whose average grain diameter is equal to or less than 250 $\mu$m, is equal to or less than 60% relative to the whole of said roseki content.

5. A continuous casting nozzle according to claim 2, wherein said binder is a thermosetting resin.

6. A continuous casting nozzle for casting molten steel, wherein the surface layer of the bore of said continuous casting nozzle contacting with the molten steel is formed of a refractory comprising:

(a) graphite from 10 to 35 wt %:

(b) an aggregate of 10 to 60 wt % selected from alumina, zirconia, zircon, or alumina-silica;

(c) roseki containing the pyrophyllite ($Al_2O_3 \cdot 4SiO_2 \cdot H_2O$) as the main component as the remaining part of the above mentioned materials; and a binder being added to said refractory, said refractory with said binder added being kneaded, formed and sintered in an anti-oxidizing atmosphere, wherein said forming process is a CIP process.

7. A continuous casting nozzle according to claim 2, wherein said roseki containing the pyrophyllite as the main component, is calcinated at a temperature equal to or greater than 800° C. so as to remove any residual moisture while containing an alkaline component from 1 to 5 wt %.

* * * * *